US007346306B2

(12) United States Patent
Cho

(10) Patent No.: US 7,346,306 B2
(45) Date of Patent: Mar. 18, 2008

(54) FIXING DEVICE BUILT IN ELECTROPHOTOGRAPHIC IMAGE FORMING APPARATUS, TEMPERATURE CONTROL METHOD FOR FIXING DEVICE, AND RECORDING MEDIUM HAVING EMBODIED THEREON COMPUTER PROGRAM FOR THE SAME

(75) Inventor: Myong-hun Cho, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/314,021

(22) Filed: Dec. 22, 2005

(65) Prior Publication Data

US 2006/0140656 A1 Jun. 29, 2006

(30) Foreign Application Priority Data

Dec. 23, 2004 (KR) ..... 10-2004-0111106

(51) Int. Cl.
*G03G 15/20* (2006.01)

(52) U.S. Cl. ..... 399/329; 399/330

(58) Field of Classification Search ..... 399/33, 399/67, 69, 122, 320, 328, 330
See application file for complete search history.

(56) References Cited

U.S. PATENT DOCUMENTS

| | | | | |
|---|---|---|---|---|
| 4,777,575 | A * | 10/1988 | Yamato et al. | 363/21.1 |
| 5,204,723 | A * | 4/1993 | Hanada et al. | 399/335 |
| 5,682,576 | A | 10/1997 | Sakai et al. | |
| 6,359,269 | B1 * | 3/2002 | Hayasaki et al. | 219/665 |
| 2002/0061200 | A1 * | 5/2002 | Sakakibara et al. | 399/69 |

FOREIGN PATENT DOCUMENTS

| | | |
|---|---|---|
| JP | 53-060236 | 5/1978 |
| JP | 63-191178 | 8/1988 |
| JP | 10-090310 | 4/1998 |
| JP | 2001-051545 | 2/2001 |
| JP | 2001-265155 | 9/2001 |
| JP | 2003-345171 | 12/2003 |
| KR | 1996-0029928 | 8/1996 |
| KR | 2003-0039166 | 5/2003 |
| KR | 10-2004-0000055 | 1/2004 |

OTHER PUBLICATIONS

English translation of Haasuto (JP Pub # 10-090310).*

* cited by examiner

*Primary Examiner*—David M. Gray
*Assistant Examiner*—Geoffrey T Evans
(74) *Attorney, Agent, or Firm*—Roylance, Abrams, Berdo & Goodman, L.L.P.

(57) ABSTRACT

A fixing device built in an electrophotographic image forming apparatus and a temperature control method for the fixing device are provided. The fixing device comprises a power supplying unit for supplying power to the fixing device; a control variable determination unit for determining control variables corresponding to operating states of the fixing device, wherein the control variables are used to control a temperature of the fixing device; a temperature detection unit for detecting the temperature of the fixing device; and a temperature control unit for controlling the temperature of the fixing device by using the control variables, wherein the temperature control unit comprises a duty ratio adjustment unit for adjusting a duty ratio of the supplied power based on the determined control variables. In addition, the control variable determination unit determines the control variables corresponding to at least one of a plurality of operating states.

18 Claims, 10 Drawing Sheets

FIXING DEVICE BUILT IN ELECTROPHOTOGRAPHIC IMAGE FORMING APPARATUS, TEMPERATURE CONTROL METHOD FOR FIXING DEVICE, AND RECORDING MEDIUM HAVING EMBODIED THEREON COMPUTER PROGRAM FOR THE SAME

CROSS-REFERENCE TO RELATED PATENT APPLICATION

This application claims the benefit under 35 U.S.C. §119 (a) of Korean Patent Application No. 10-2004-0111106, filed on Dec. 23, 2004, in the Korean Intellectual Property Office, the entire disclosure of which is hereby incorporated by reference.

BACKGROUND OF THE INVENTION

1. Field of the Invention

The present invention relates to an electrophotographic image forming apparatus. More particularly, the present invention relates to a temperature control method for controlling in a stable manner a temperature of a fixing device built in an electrophotographic image forming apparatus and a fixing device having a constant temperature maintaining function.

2. Description of the Related Art

High performance electrophotographic image forming apparatuses are widely used for printing and have been extensively developed. The electrophotographic image forming apparatus performs printing by using a series of operations. The operations can include conduction, exposure, development, transferring, and fixing operations.

In the printing operation, charges generated by a conductor are formed on a surface of a photosensitive drum. A sheet of paper in a paper cassette is picked up and conveyed by a pick-up roller. Here, the surface of the photosensitive drum is exposed to a laser scanner unit (LSU), so that an electrostatic image can be formed on the surface. More specifically, the LSU emits laser beams corresponding to image data and directs them toward the surface of the photosensitive drum. In synchronization with the exposure operation, the paper sheet is transmitted to a transferring unit. The electrostatic image formed on the exposed surface of the photosensitive drum is developed by using toner supplied from a developing unit. As a result, the toner adhered on the surface of the photosensitive drum is transferred to the paper sheet. Next, the transferred paper sheet is transmitted to a fixing device having a heating roller and pressing roller. The fixing device fixes the toner on the paper sheet by using heat and pressure of the heating and pressing rollers. The toner-fixed paper sheet is fed out by a feeding roller, so that the printing operation for one paper sheet is completed.

The fixing device built in the electrophotographic image forming apparatus has a shape of tube. A heating lamp is provided as a heating device in an inner portion of the tube. In order to accurately perform the fixing operation, the fixing device must be maintained in a predetermined proper temperature. More specifically, the surface of the fixing device must be maintained in a proper target temperature in order to fix the toner on the paper sheet. The proper target temperature is called a printing temperature. The printing temperature depends on the fusing temperature of a developer and the thickness of the paper sheet used for the electrophotographic image forming apparatus.

In a conventional fixing device, a halogen lamp is used as the heating lamp. By turning on/off the halogen lamp, the temperature of the fixing device is increased up to or maintained in the proper target temperature for accurately fixing the toner on the paper sheet. More specifically, by turning on the halogen lamp, the temperature of the fixing device is increased from a room temperature to the target temperature. When the fixing device reaches the target temperature, the halogen lamp is turned off. Next, when the temperature of the fixing device decreases below the target temperature, the halogen lamp is turned on again.

FIG. 1 is a flowchart of a temperature control method for a conventional fixing device built in an electrophotographic image forming apparatus.

Firstly, it is determined whether or not a reference time for detecting the temperature of the fixing device has elapsed. The reference time denotes a time period for performing the temperature control operations for the fixing device. If the reference time elapses, it is determined whether or not the fixing device reaches a reference temperature. If the fixing device reaches the reference temperature, a heating lamp is turned off. If the fixing device does not reach the reference temperature, the heater is operated for a predetermined operating time. As shown in FIG. 1, in the conventional fixing device, the heating lamp is turned on and off by using unchangeable reference time and temperature.

FIG. 2 is a graph showing a change in temperature of the conventional fixing device built in the electrophotographic image forming apparatus.

If the temperature of the fixing device decreases below a target temperature TPT, the heating lamp is operated during a time interval (TI1, TI2) to increase the temperature of the fixing device. After that, the temperature of the fixing device continues to increase and exceeds the target temperature TPT, which is called overshoot. If overshoot occurs, the heating lamp is turned off to decrease the temperature of the fixing device. As a result, the temperature of the fixing device is allowed to decrease below the target temperature TPT. At this time, the heating lamp is turned on to increase the temperature of the fixing device. Due to the repeated heating and cooling of the fixing device, there occurs the so-called rippling, that is, a fluctuation of the temperature of the fixing device.

Unfortunately, the overshoot and rippling results in increasing power consumption and shortening the lifespan of the fixing device and its parts.

Therefore, in order to accurately fix the toner on the paper sheet, there is a need to stably control the temperature of the fixing device. In addition, there is a need to minimize the overshoot and rippling, which are affected by thermal conduction delay and thermal retention of a rubber layer of a fixing roller.

SUMMARY OF THE INVENTION

The present invention provides a temperature control method for controlling a temperature of a fixing device by using different control variables corresponding to the operating states of the fixing device in order to minimize the overshoot and rippling of the temperature of the fixing device.

The present invention also provides a fixing device having its temperature controlled by using at least two reference times and temperatures in order to reduce power consumption and extend the lifespan of the fixing device and its parts.

According to an aspect of the present invention, there is provided a fixing device built in an electrophotographic image forming apparatus, comprising a power supplying unit for supplying power to the fixing device; a control variable determination unit for determining control variables corresponding to operating states of the fixing device, wherein the control variables are used to control a temperature of the fixing device; a temperature detection unit for detecting the temperature of the fixing device; and a temperature control unit for controlling the temperature of the fixing device by using the control variables, wherein the temperature control unit comprises a duty ratio adjustment unit for adjusting a duty ratio of the supplied power based on the determined control variables.

In the aspect of the present invention, the control variable determination unit may determine the control variables corresponding to at least one of a plurality of operating states comprising a standby state, a warming-up state, a pre-printing state, a printing state, and a post-printing.

In addition, the control variables may comprise target temperatures corresponding to the plurality of operating states; at least one of a plurality of reference temperatures used for comparison to the temperature of the fixing device; at least one of a plurality of reference times for detecting the temperature of the fixing device; and at least one of a plurality of duty ratios varying corresponding to the reference temperatures and the reference times.

In addition, the control variable determination unit may comprise a control variable updating unit for updating the control variables based on an output temperature of the fixing device controlled by the temperature control unit.

In addition, if the temperature of the fixing device is lower than the target temperature, the duty ratio adjustment unit may compare the temperature of the fixing device to at least one of the reference temperatures and increase the duty ratio in proportion to the difference between the target temperature and the temperature of the fixing device.

According to another aspect of the present invention, there is provided a temperature control method for a fixing device built in an electrophotographic image forming apparatus, comprising the steps of determining control variables corresponding to operating states of the fixing device, wherein the control variables are used to control a temperature of the fixing device; detecting the temperature of the fixing device; and controlling the temperature of the fixing device by adjusting a duty ratio of power supplied to the fixing device by using the control variables.

In the aspect of the present invention, the operating states may comprise at least one of a standby state, a warming-up state, a pre-printing state, a printing state, and a post-printing.

In addition, the control variables may comprise target temperatures corresponding to the operating states; at least one of the reference temperatures used for comparison to the temperature of the fixing device; at least one of reference times for detecting the temperature of the fixing device; and at least one of the duty ratios varying corresponding to the reference temperatures and the reference times.

In addition, the determining of the control variables may comprise updating the control variables based on the controlled temperature of the fixing device.

In addition, the controlling of the temperature may comprise the step of, if the temperature of the fixing device is lower than the target temperature, increasing the temperature of the fixing device by increasing the duty ratio in proportion to the difference between the target temperature and the temperature of the fixing device; and if the temperature of the fixing device is lower than the target temperature, decreasing the temperature of the fixing device by decreasing the duty ratio in proportion to the difference between the target temperature and the temperature of the fixing device.

According to still another aspect of the present invention, there is provided a computer-readable recording medium having embodied thereon a computer program for the temperature control method.

Accordingly, the temperature of the fixing device can be stably controlled, so that it is possible to reduce power consumption and extend the lifespan of the fixing device and its parts.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numerals refer to similar features, elements and structures.

DETAILED DESCRIPTION OF EXEMPLARY EMBODIMENTS

The attached drawings for illustrating exemplary embodiments of the present invention are referred to in order to gain a sufficient understanding of the present invention, the merits thereof, and the objectives accomplished by the implementation of the present invention.

Hereinafter, the present invention will be described in detail by explaining exemplary embodiments of the invention with reference to the attached drawings.

Figure 1:
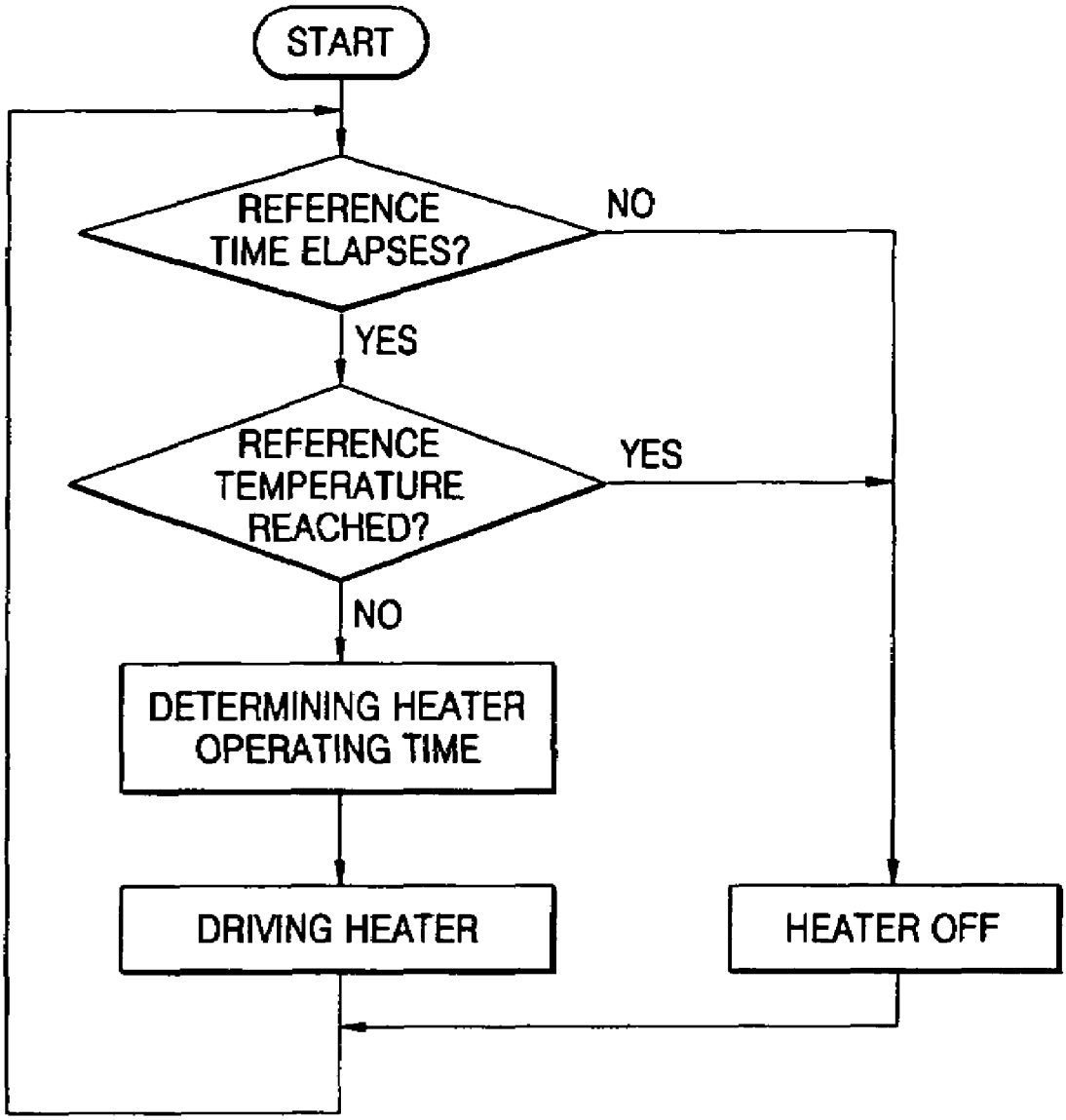
FIG. 1 (PRIOR ART)
FIG. 1 is a flowchart of a temperature control method for a conventional fixing device built in an electrophotographic image forming apparatus.
Figure 2:
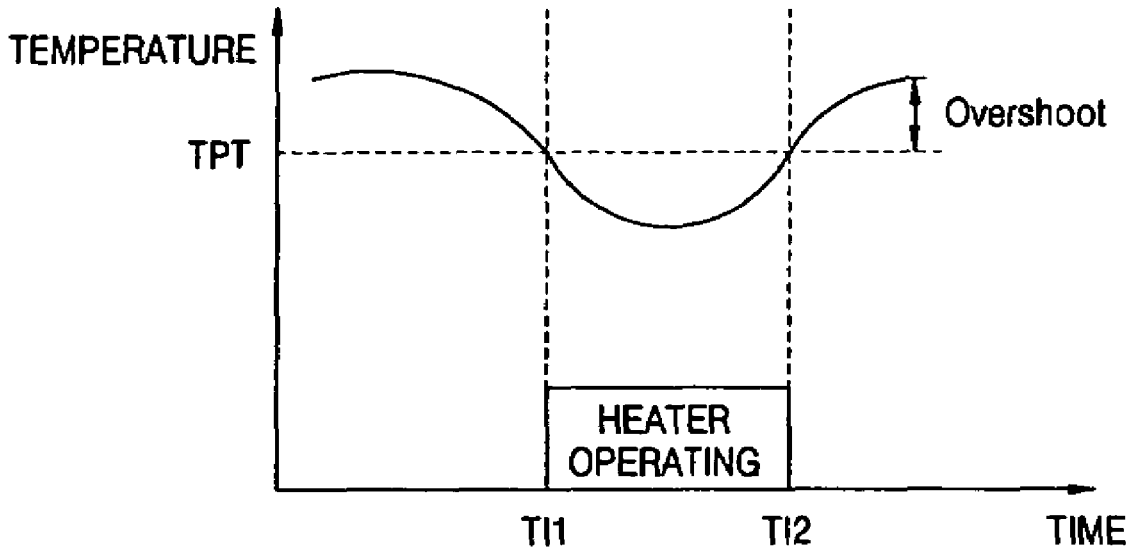
FIG. 2 (PRIOR ART)
FIG. 2 is a graph showing a change in temperature of the conventional fixing device built in the electrophotographic image forming apparatus.
Figure 3:
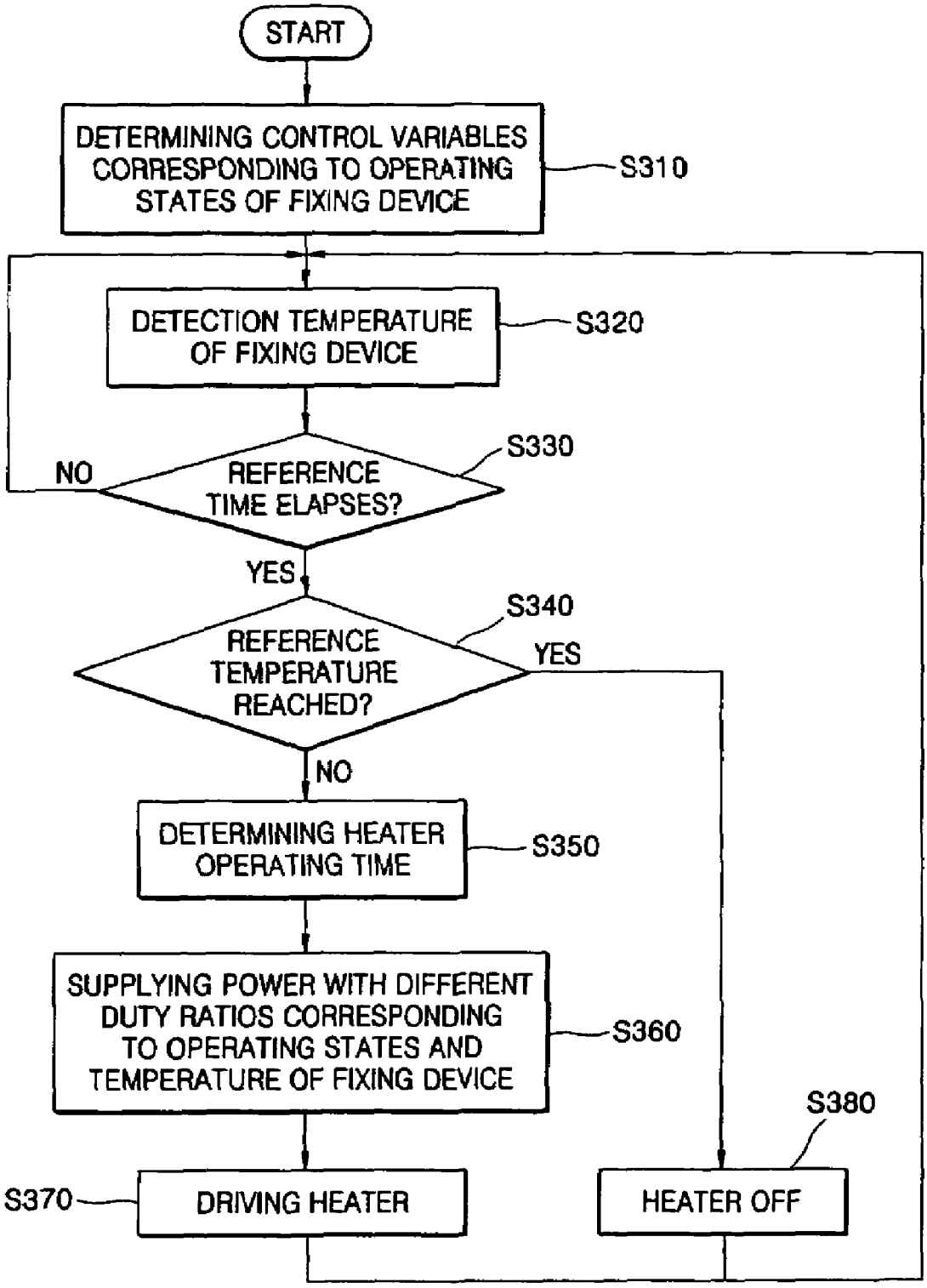
FIG. 3 is a flowchart of a temperature control method for a fixing device according to an embodiment of the present invention.

FIG. 3 is a flowchart of a temperature control method for a fixing device according to an embodiment of the present invention.

In the temperature control method, control variables are determined corresponding to the operating states of the fixing device (S310). In an exemplary embodiment, the operating states include a standby state, a warming-up state, a pre-printing state, a printing state, and a post-printing state. The standby state is a state where the electrophotographic image forming apparatus is waiting for a printing command. In the standby state, the temperature (that is, a standby temperature) of the electrophotographic image forming apparatus is maintained preferably at about 165° C. If the standby temperature is too low, it takes too long a time to increase the temperature of the fixing device to a predetermined printing temperature. On the other hand, if the standby temperature is too high, power loss is very large. Therefore, the standby temperature preferably is an intermediate temperature in order to rapidly increase the temperature of the fixing device just after the printing command is received. During the printing operation of the electrophotographic image forming apparatus, the temperature of the fixing device is maintained preferably at about 185° C. The printing state is a state just before the printing operation proceeds. The post-printing state is a state just after the printing operation is completed.

The aforementioned classified operating states of the fixing device are needed for the following reasons.

If the different control variables are prepared corresponding to the different operating states, the temperature can be optimally controlled. More specifically, in the standby state, the temperature of the fixing device must be rapidly increased to the standby target temperature and the standby target temperature must be maintained. In the pre-printing state, the temperature of the fixing device must be rapidly increased from the standby target temperature to the printing target temperature. In the printing state, the temperature of the fixing device must be maintained at the reached printing target temperature without rippling. In the post-printing state, the temperature of the fixing device must be decreased from the printing target temperature down to the standby target temperature.

Since the temperature of the fixing device is controlled by using the different control variables corresponding to the classified operating states of the fixing device, it is possible to optimally control the temperature of the fixing device. The control variables preferably include the target temperatures corresponding to the operating states; at least one of the plurality of reference temperatures used for comparison to the temperature of the fixing device; at least one of the plurality of reference times for detecting the temperature of the fixing device; and at least one of the plurality of duty ratios varying corresponding to the reference temperatures and the reference times. For example, the standby target temperature is lower than the printing target temperature. In addition, since the temperature in the standby state does not largely change, the temperature in the standby state is not frequently detected in comparison to the temperatures in the printing and post-printing states. Therefore, the reference time in the standby state may be longer than those in the printing and post-printing states. On the other hand, in the case where a rapid temperature change is needed, the reference times can be shortened.

Preferably, in the temperature control method for the fixing device according to an exemplary embodiment of the present invention, heating by on and off chopping of a heating lamp is controlled to change the temperature of the fixing device. The control of the on and off chopping denotes repeatedly turning on and off the heating lamp for a predetermined time interval instead of turning on or off the heating lamp and maintaining the heating lamp in the on or off setting for the entire predetermined time interval. Due to the chopping operation, overshoot or rippling of the temperature of the fixing device can be reduced. The overshoot denotes a state where the temperature of the fixing device exceeds a target temperature. The rippling denotes a state where the temperature of the fixing device is fluctuating around a target temperature.

A method for controlling the temperature of a fixing device according to an embodiment of the present invention will now be described in more detail with reference to FIG. 3. The control variables may comprise a duty ratio that is changed corresponding to the reference times and the reference temperatures. If the temperature of the fixing device is controlled by using the different duty ratios corresponding to the respective operating states, it is possible to optimally control the constant temperature in the operating states (S310).

Next, the temperature of the fixing device is detected (S320). As described above, the temperature of the fixing device is controlled by using the reference times and the reference temperatures. Next, it is determined whether or not one of the reference times has elapsed (S330). Here, as described above, the control operation for the fixing device can be performed rapidly by using the aforementioned shortened reference time. If the reference time elapses, it is determined whether or not the fixing device has reached the reference temperature (S340). If the fixing device has reached the reference temperature, the heater is turned off (S380). Although the temperature of the fixing device can be decreased by turning off the heater, the temperature may decrease too rapidly. Therefore, the temperature of the fixing device may be more gradually decreased by using a lower duty ratio so that the decrease in temperature of the fixing device due to thermal loss can be attenuated. If the temperature of the fixing device is controlled by using the duty ratio, it is possible to reduce overshoot or rippling of the temperature, as described above.

If the fixing device has not reached the reference temperature, the temperature of the fixing device continues to be increased. Therefore, the turn-on time interval of the heater is determined (S350). In addition, the fixing device is supplied with power at different duty ratios corresponding to the operating states and temperatures of the fixing device (S360). Next, the heater is operated by using the different duty ratios, so that the temperature of the fixing device can be increased to the reference temperature (S370).

Preferably, at least two reference times and temperatures are prepared as the control variables. By using at least two reference times and temperatures, the temperature of the fixing device can be more actively controlled. The control variables, including the reference times and temperatures can be set up at the time of manufacturing the fixing-device. Furthermore, an updating capability may be built into the electrophotographic image forming apparatus allowing for repeated updating of the control variables based on the number of operations of the fixing-device, or based on other factors affecting the heating times and/or temperatures. Thereby, any variations in manufacturing or worn parts can be actively compensated for by repeatedly updating the control variables. In a conventional temperature control method, unchangeable reference times and temperatures are used for a temperature control method, so that the present characteristics of the fixing device cannot be taken into consideration. However, in the temperature control method according to the present invention, the control variables are updated, so that the present characteristics of the fixing device can be taken into consideration.

Figure 4:
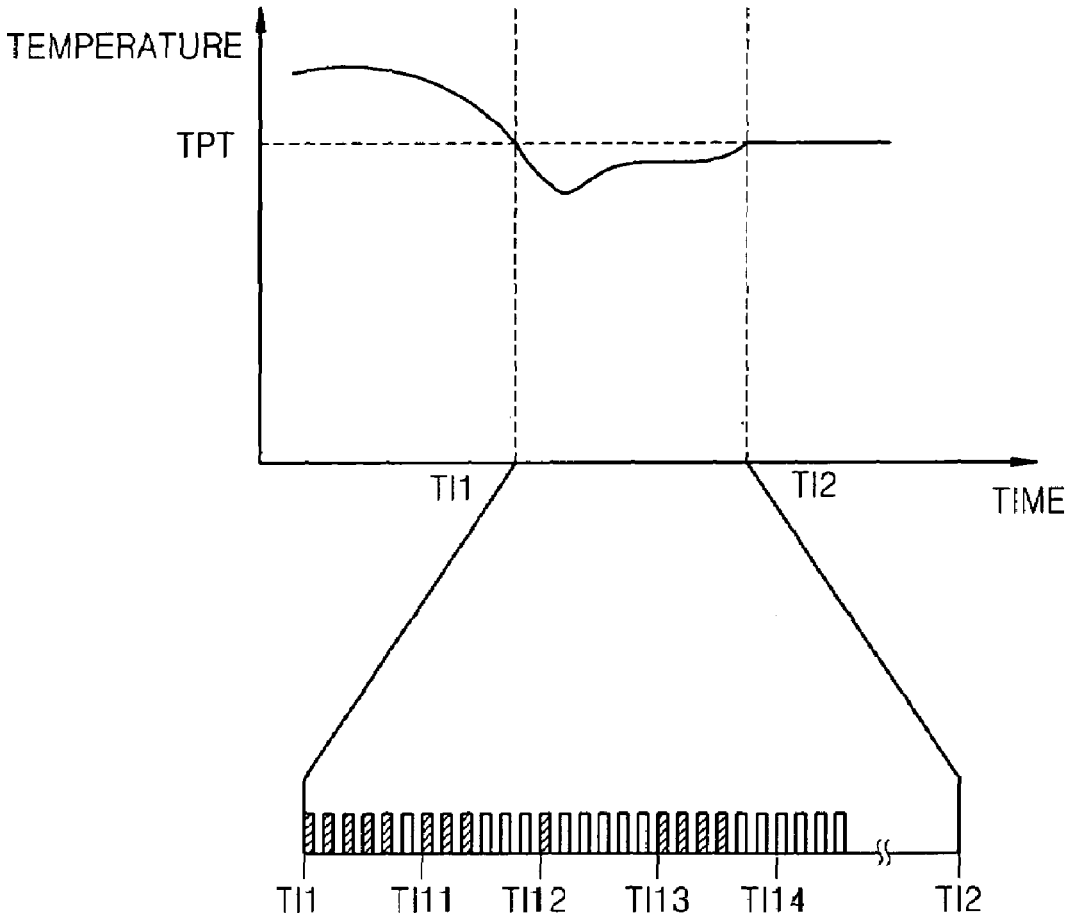
FIG. 4 is a graph showing a change in temperature of the fixing device according to the embodiment of the present invention.

FIG. 4 is a graph showing a change in temperature of the fixing device according to the embodiment of the present invention.

In a predetermined time interval (TI1, TI2), the temperature of the fixing device is lower than a target temperature TPT. The time interval (TI1, TI2) is divided into a plurality of reference times. For example, the time interval (TI1, TI2) is divided into reference times TI11, TI12, TI13, and TI14. The reference times correspond to different duty ratios. In the example shown in FIG. 4, a duty ratio of (5/6)x 100=83.3% is used for the time interval (TI1, TI11); a duty ratio of (3/6)x100=50% is used for the time interval (TI11, TI12); a duty ratio of (1/6)x100=16.7% is used for the time interval (TI12, TI13); and a duty ratio of (4/6)x100=66.7% is used for the time interval (TI13, TI14). Since the duty ratios used for the time intervals are examples, the present invention is not limited thereto.

As shown in FIG. 4, a predetermined time interval is divided into a plurality of reference times, and different duty ratios are used for the corresponding reference times, so that it is possible to rapidly control the temperature of the fixing device.

Although the example of FIG. 4 shows a method of controlling the temperature of the fixing device by using at least one "reference time," the method can be used to control the temperature of the fixing device by using "a plurality of duty ratios" corresponding to each of the reference times.

Figure 5:
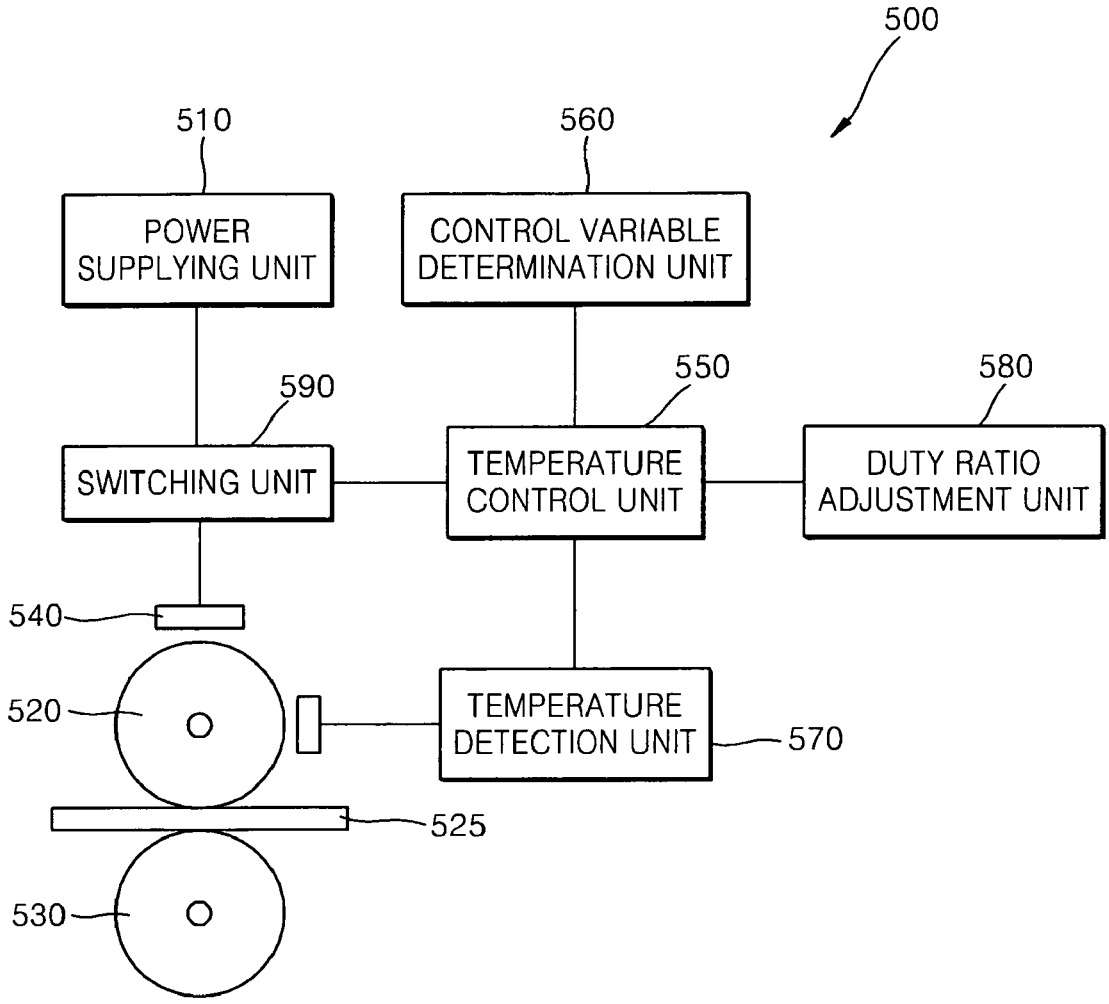
FIG. 5 is a block diagram showing of a fixing device according to another embodiment of the present invention.

FIG. 5 is a block diagram showing a fixing device according to an exemplary embodiment of the present invention.

The fixing device 500 according to an exemplary embodiment of the present invention comprises a power supplying unit 510, a fixing roller 520, a pressing roller 530, an overheat sensor (thermostat) 540, a temperature control unit 550, a control variable determination unit 560, a temperature detection unit 570, a duty ratio adjustment unit 580, and a switching unit 590. When a paper sheet 525 is inserted between the fixing roller 520 and the pressing roller 530, the fixing operation starts.

The power supplying unit 510 supplies power to the fixing roller 520 and the pressing roller 530. The control variable determination unit 560 determines control variables corresponding to the operating states of the fixing device 500. The control variables are used to control the temperature of the fixing device 500. The temperature detection unit 570 detects the temperature of the fixing device using a temperature sensing means. The temperature control unit 550 controls the temperature of the fixing device by using the determined control variables. The duty ratio adjustment unit 580 adjusts the duty ratios (of the power supplied by the power supplying unit 510) corresponding to the control variables determined by the, control variable determination unit 560 to control the temperature, of the fixing device 500.

As described above, the control variable may comprise target temperatures corresponding to the operating states; at least one of a plurality of reference temperatures used for comparison to the temperature of the fixing device; at least one of a plurality of reference times for detecting the temperature of the fixing device; and at least one of a plurality of duty ratios varying corresponding to the reference temperatures and the reference times.

If the temperature of the fixing device 500 is lower than the target temperature, duty ratio adjustment unit 580 compares the temperature of the fixing device 500 to at least one of the reference temperatures and increases the duty ratio in proportion to the difference between the reference temperature and the temperature of the fixing device 500. That is, the fixing device 500 is heated by using the larger duty ratios when the temperature of the fixing device 500 is lower than the target temperature. On the other hand, if the temperature of the fixing device 500 is higher than the target temperature, the duty ratio adjustment unit 580 compares the temperature of the fixing device 500 to at least one of the reference temperatures and decreases the duty ratio in proportion to the difference between the reference temperature and the temperature of the fixing device 500 to allow the fixing device 500 to cool. That is, the fixing device 500 is cooled by using the smaller duty ratios when the temperature of the fixing device 500 is higher than the target temperature.

In addition, the duty ratio adjustment unit 580 may adjust the duty ratios so that the duty ratios for a paper fixing device where a paper sheet is inserted between the fixing roller 520 and the pressing roller 530 are larger than the duty ratios for a non-paper fixing device where the paper sheet is not inserted between the fixing roller 520 and the pressing roller 530. Although the paper and non-paper fixing devices are heated with the same duty ratios; the change in the temperature of the paper fixing device is smaller than that of the non-paper fixing device. Therefore, the fixing device 500 according to another exemplary embodiment can sense the sheet of paper and adjust the duty ratios corresponding to the presence and absence of the paper sheet.

If the increasing surface temperature of the fixing device 500 exceeds a predetermined threshold value, the overheat sensing unit 540 shuts off the power supplied to the fixing device 500 to prevent overheating. The overheat sensing unit 540 prevents damage to the fixing device 500 and other peripheral devices.

The switching unit 590 is preferably a trial for blocking the power supplied from the power supplying unit 510 under the control of the temperature control unit 550. The trial, a kind of semiconductor switching device, is generally manufactured by stacking five semiconductor layers p-n-p-n-p. The trial has two electrodes and a third control electrode (gate electrode) to control current like a triode. The trial can control only the average of sinusoidal AC current. The trial does not control or block an instantaneous current. Therefore, the waveform of the current is not distorted by the trial, so that the trial has a high efficiency without generating a high frequency.

The temperature detection unit 570 detects a temperature of the fixing roller 520. Typically, a thermistor having a negative resistance temperature characteristic is used for the temperature detection unit 570. The temperature detection unit 570 has different resistance values according to the temperature of the fixing roller 520. The voltage level signal corresponding to the different resistance values is input to the temperature control unit 550. Typically, The temperature detection unit 570 uses an analog-to-digital converter (ADC) or a comparator circuit to convert the detected temperature to digital data having the corresponding voltage level value and input the digital data to the temperature control unit 550.

The temperature control unit 550 controls the temperature of the fixing device 500 by using various control variables to minimize the overshoot. As described above, the overshoot denotes a state where the temperature of the fixing device 500 is higher than a target temperature. The overshoot results in an increase in the temperatures of the fixing roller 520 and the pressing roller 530, so that seizing of the rollers may occur. In addition, since a frame adjacent to the fixing roller 520 may be made of a polymer material, the overshoot, which can be a thermal impact to the polymer material, may result in a thermal distortion of the polymer material. In addition, the overshoot results in hot offset. The hot offset denotes a state where toner remnants on the surface of the fixing roller 520 deteriorate printing quality.

As described above, the control variable determination unit 560 can update the previously stored control variables based on the control result.

Figure 6A:
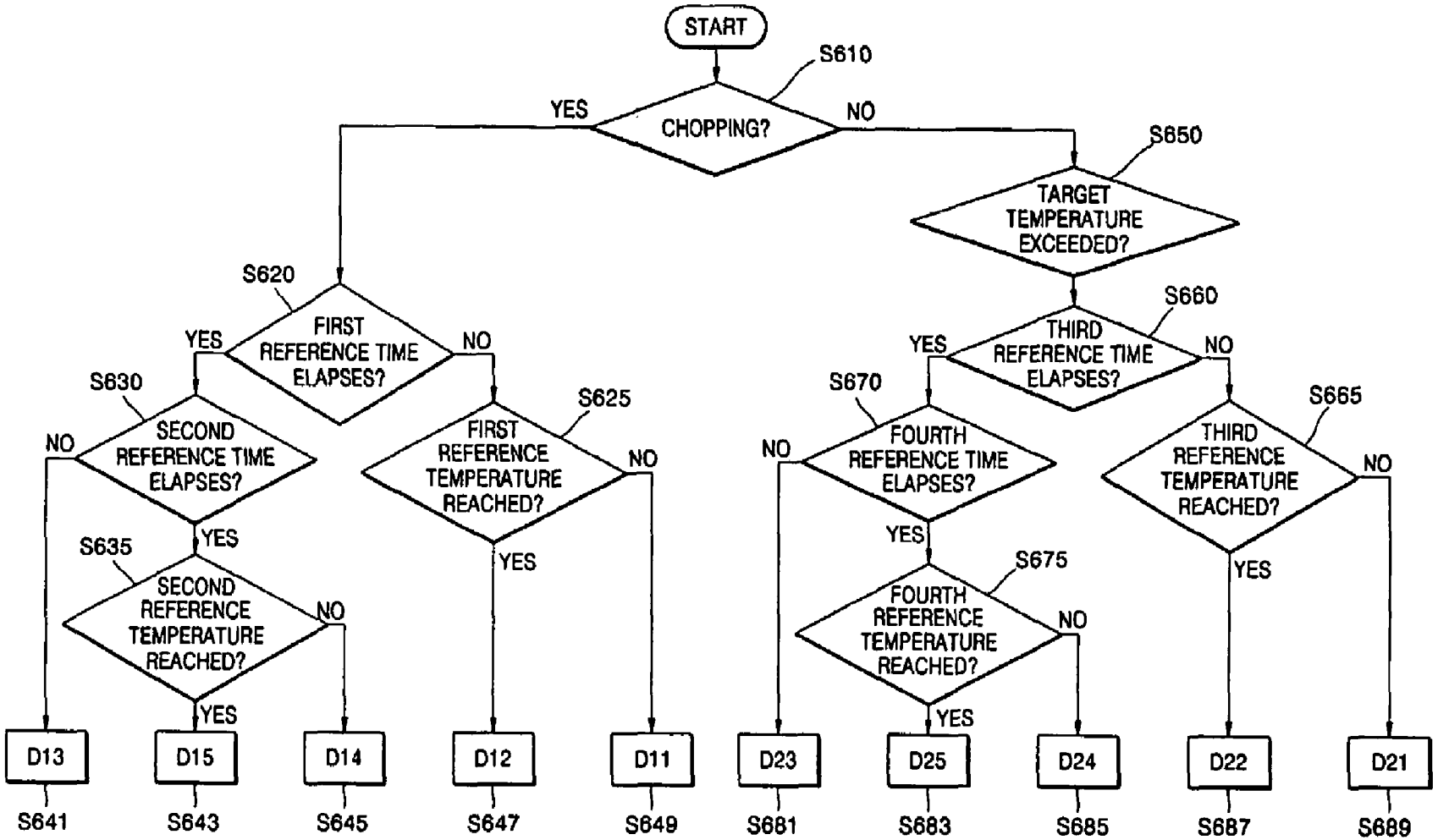
FIG. 6A is a flowchart of an example of a temperature control method for the fixing device according to the embodiment of the present invention.

FIG. 6A is a flowchart of an exemplary temperature control method for the fixing device according to the embodiment of the present invention.

Firstly, it is determined whether or not a chopping operation is needed to increase the temperature of the fixing device (S610). The chopping operation is needed to prevent a rapid change in the temperature of the fixing device. If the chopping operation is needed, the temperature of the fixing device must be increased. Next, it is determined whether or not a first reference time elapses (S620). If the first reference time does not elapse, the temperature of the fixing device may be rapidly increased. Next, it is determined whether or not the fixing device reaches the first reference temperature (S625). If the fixing device does not reach the first reference temperature, the temperature of the fixing device is increased by using a first duty ratio D11 (S649). If the fixing device reaches the first reference temperature, the temperature of the fixing device is increased by using a second duty ratio D12 which is smaller than the first duty ratio D12 (S647).

If the first reference time elapses, it is determined whether or not a second reference time elapses (S630). If the first reference time elapses and the second reference time does not elapse, the temperature of the fixing device is increased by using a third duty ratio D13, which is smaller than the second duty ratio D12 (S641). If the second reference time elapses, the temperature of the fixing device is compared to a second reference temperature (S635). If the fixing device does not reach the second reference temperature, the temperature of the fixing device is increased by using a fourth duty ratio D14, which is smaller than the third duty ratio D13 (S645). If the fixing device reaches the second reference temperature, the temperature of the fixing device is increased by using a fifth duty ratio D15, which is smaller than the fourth duty ratio D14 (S643).

In this manner, the temperature of the fixing device is increased by using different duty ratios corresponding to whether or not the first and second reference times elapse. In addition, the temperature of the fixing device is controlled by using different duty ratios corresponding to whether or not the fixing device reaches the first and second reference temperatures. A preferred relation among the first to fifth duty ratios is represented by Equation 1.

$$D11>D12>D13>D14>D15 \quad \text{[Equation 1]}$$

A large duty ratio denotes a rapid increase in the temperature of the fixing device.

If the chopping operation is not needed, the temperature of the fixing device must be decreased. This case occurs when the operating state changes from the printing state to the standby state. In addition, this case occurs when the temperature of the fixing device is rapidly increased due to an external factor. If the temperature of the fixing device is rapidly increased beyond a target temperature, the temperature must be decreased down to a target temperature corresponding to the operating states.

Firstly, it is determined whether or not the temperature of the fixing device exceeds a target temperature (S650). In addition, it is determined whether or not a third reference time elapses (S660). If the third reference time does not elapse, the temperature of the fixing device may be rapidly decreased. Therefore, it is determined whether or not the fixing device reaches the third reference temperature (S665). If the fixing device does not reach the third reference temperature, the power of the fixing device is controlled by using a sixth duty ratio D21 to decrease the temperature of the fixing device (S689). Preferably, the sixth duty ratio D21 is about 0. If the fixing device reaches the third reference temperature, the temperature of the fixing device is gradually decreased by using a seventh duty ratio D22, which is larger than the sixth duty ratio. (S687).

If the third reference time elapses, it is determined whether or not a fourth reference time elapses (S670). If the third reference time elapses and the fourth reference time does not elapse, the temperature of the fixing device is decreased by using an eighth duty ratio D23, which is larger than the seventh duty ratio D22 (S681). If the fourth reference time elapses, it is determined whether or not the temperature of the fixing device reaches a fourth reference temperature (675). If the fixing device does not reach the fourth reference temperature, the temperature of the fixing device is decreased by using a ninth duty ratio D24, which is larger than the eighth duty ratio D23 (S685). If the fixing device reaches the fourth reference temperature, the temperature of the fixing device is constantly maintained by using a tenth duty ratio D25, which is larger than the ninth duty ratio D24 (S683).

Like this, the temperature of the fixing device is decrease by using different duty ratios corresponding to weather or not the third and fourth reference times elapse. In addition, the temperature of the fixing device is controlled buy using different duty ratios corresponding to wheather or not the fixing device reaches the third and fourth reference temperature. A prefered relation among the smith to tenth duty ratios is represented by equation 2.

$$D21<D22<D23<D24<D25 \quad \text{[Equation 2]}$$

A small duty ratio denotes a rapid decrease in the temperature of the fixing device.

The temperature control method shown in FIG. 6A can be used for the warming-up and pre-printing states. Similarly, the different control variables such as reference times and reference temperatures can be selected corresponding to the operating states.

Figure 6B:
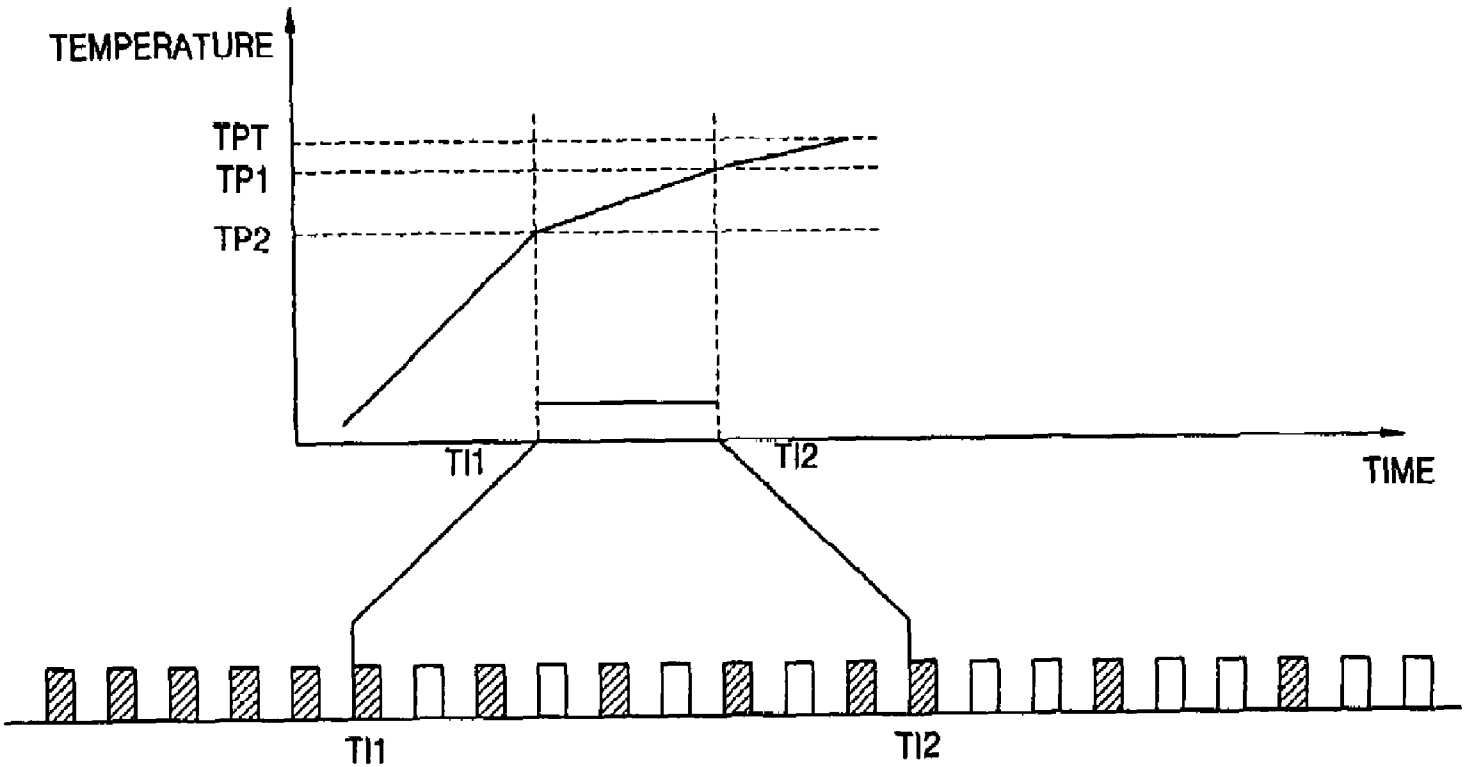
FIG. 6B is a graph showing a change in temperature of the fixing device to which the example of the temperature control method is applied.

FIG. 6B is a graph showing a change in the temperature of the fixing device to which the example of the aforementioned temperature control method is applied. More specifically, FIG. 6B shows the process of increasing the temperature of the fixing device up to a target temperature.

As described above, the result of a change in the temperature of the fixing device is obtained by applying different duty ratios to the first and second reference times TI1 and T12 and the first and second reference temperature TP1 and TP2. For the sake of convenience, the description is of a change in the duty ratio before and after the first and second reference times TI1 and T12. However, it should be noted that the same description may be made on the first and second reference temperature TP1 and TP2.

Firstly, the fixing device is heated with the largest duty ratio before the first reference time TI1 elapses. As shown in FIG. 6B, preferably, the duty ratio of 100% is used before the first reference time TI1 elapses.

In the time interval between the first and second reference times TI1 and T12, the temperature of the fixing device is controlled with a duty ratio that is smaller than the duty ratio used before the first reference time TI1 elapses. As the temperature of the fixing device approaches the final target temperature TPT, the temperature of the fixing device is changed rapidly. The object of using the smaller duty ratio is to prevent overshoot and rippling. In the example, the duty ratio of 50% is used in the time interval between the first and second reference times TI1 and T12.

If the second reference time TI2 elapses, the temperature of the fixing device is controlled by using a duty ratio smaller than the previously-used duty ratios. As shown in FIG. 6B, it can be understood that the smallest duty ratio is used after the second reference time TI2 elapses. In the example, the duty ratio of 33.3% is used after the second reference time TI2 elapses.

Figure 6C:
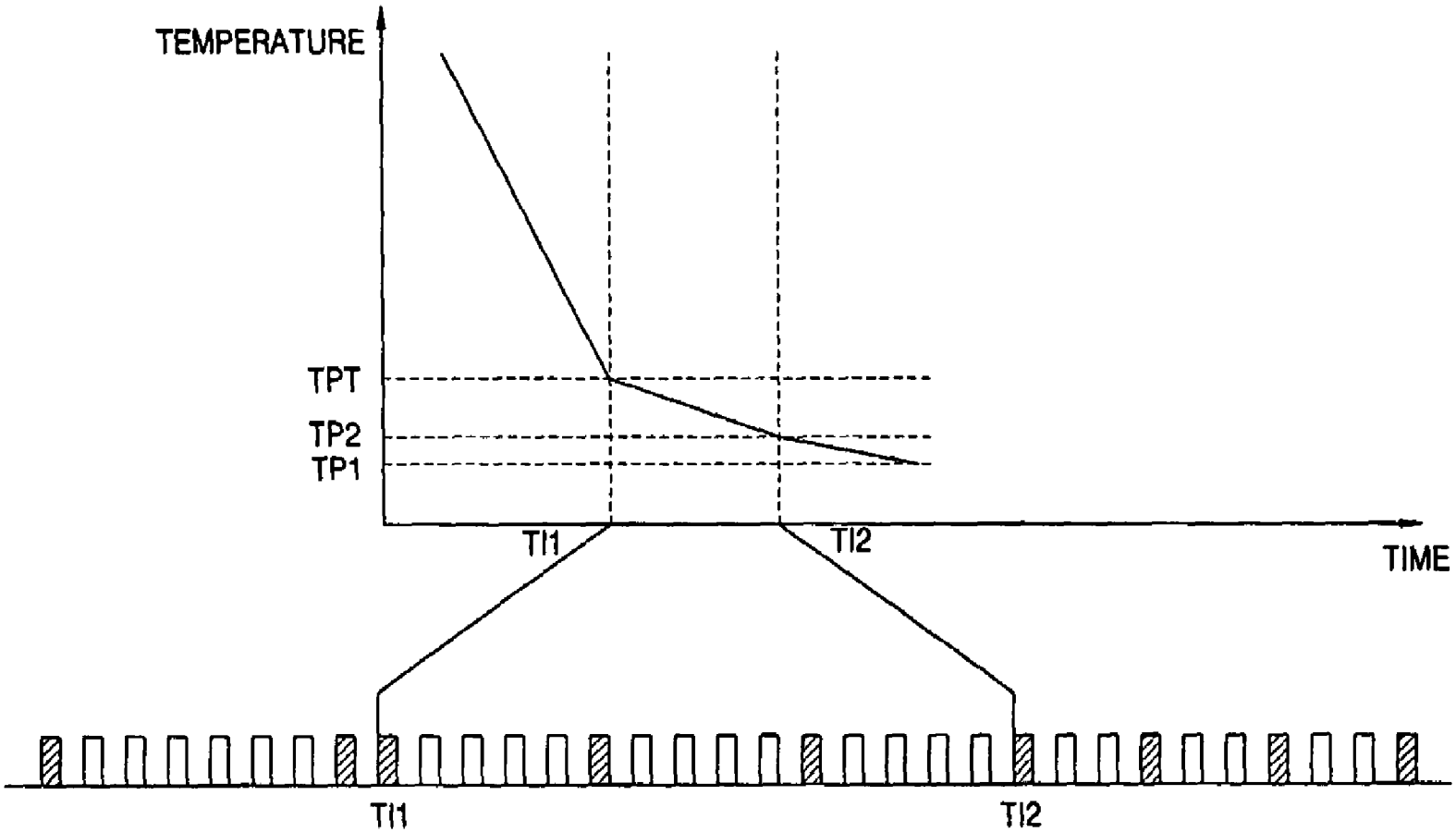
FIG. 6C is a graph showing a change in temperature of the fixing device to which another example of the temperature control method is applied.

FIG. 6C is a graph showing a change in the temperature of the fixing device to which another example of the temperature control method is applied. FIG. 6C shows a process for decreasing the temperature of the fixing device to a target temperature.

As described above, the result of the change in the temperature of the fixing device is obtained by applying different duty ratios of the first and second reference times TI1 and T12 and the first and second reference temperature TP1 and TP2. For the sake of convenience, a description is of a change in the duty ratio before and after the first and second reference times TI1 and T12. However, it should be noted that the same description may be made on the first and second reference temperature TP1 and TP2.

Firstly, the fixing device is cooled with the smallest duty ratio before the first reference time TI1 elapses. As shown in FIG. 6C, the duty ratio of (1/7)×100=14.3% is used before the first reference time TI1 elapses.

In the time interval between the first and second reference times TI1 and T12, the temperature of the fixing device is controlled with a duty ratio that is larger than the duty ratio used before the first reference time TI1 elapses. In the example, the duty ratio of 20% is used in the time interval between the first and second reference times TI1 and T12.

If the second reference time TI2 elapses, the temperature of the fixing device is controlled by using a duty ratio larger than the previously-used duty ratios. As shown in FIG. 6C, it can be understood that the largest duty ratio is used after the second reference time TI2 elapses. In the example, the duty ratio of 33.3% is used after the second reference time TI2 elapses.

Figure 7:
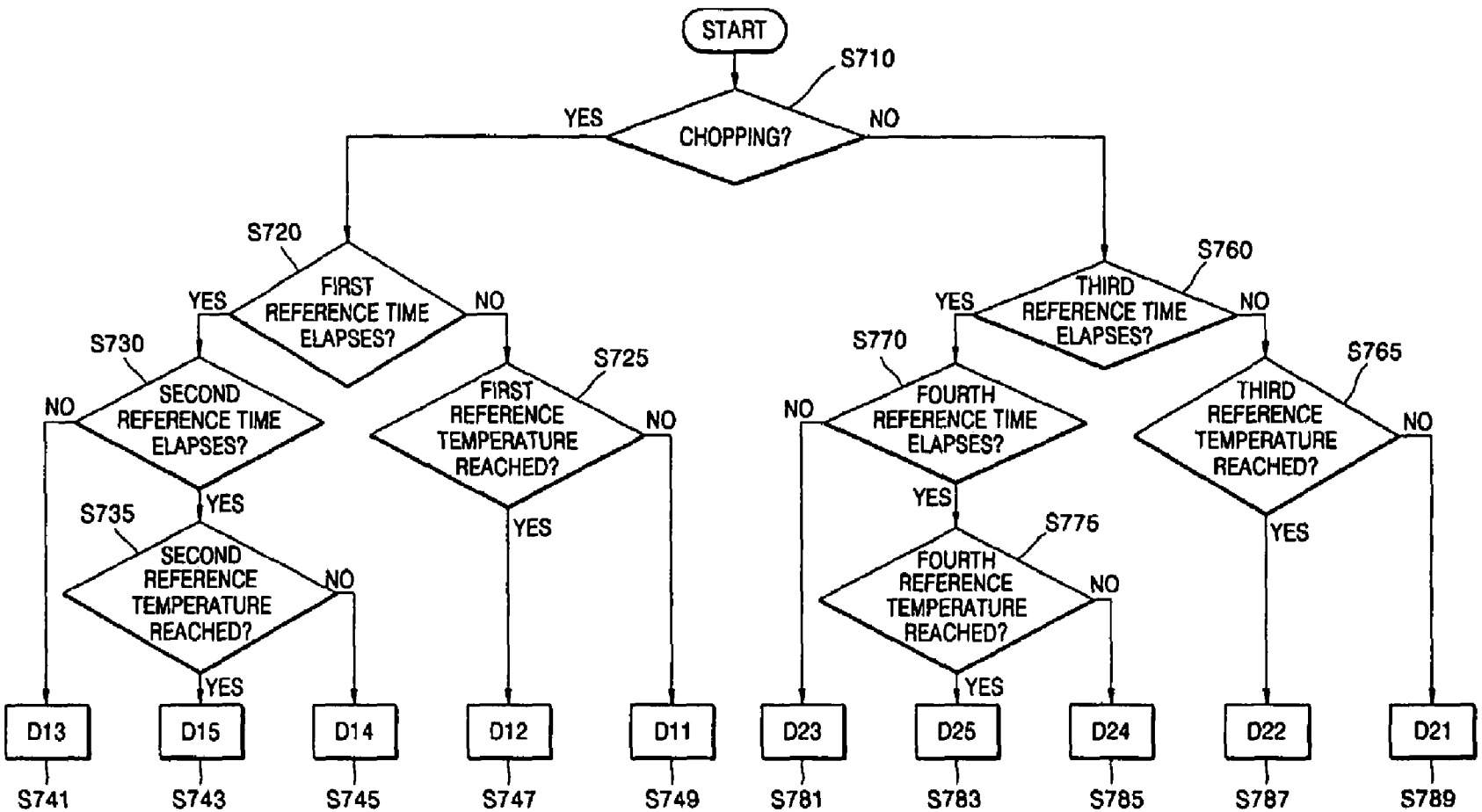
FIG. 7 is a flowchart of another example of a temperature control method for the fixing device according to the embodiment of the present invention.

FIG. 7 is a flowchart of an exemplary temperature control method for the fixing device according to an embodiment of the present invention.

In the example, the temperature control method comprises operations S720 through S749 for increasing the temperature of the fixing device when it is lower than a target temperature; and operations S760 through S789 for decreasing the temperature of the fixing device when it is higher than the target temperature. The example shown in FIG. 7 is the same as that shown in FIG. 6A except that the operation S650 of FIG. 6A is not included. The operation S650 is an operation for determining whether or not the temperature of the fixing device exceeds the target temperature. The example shown in FIG. 7 can be adapted to the standby.y state where the temperature of the fixing device is maintained within a predetermined range.

Figure 8:
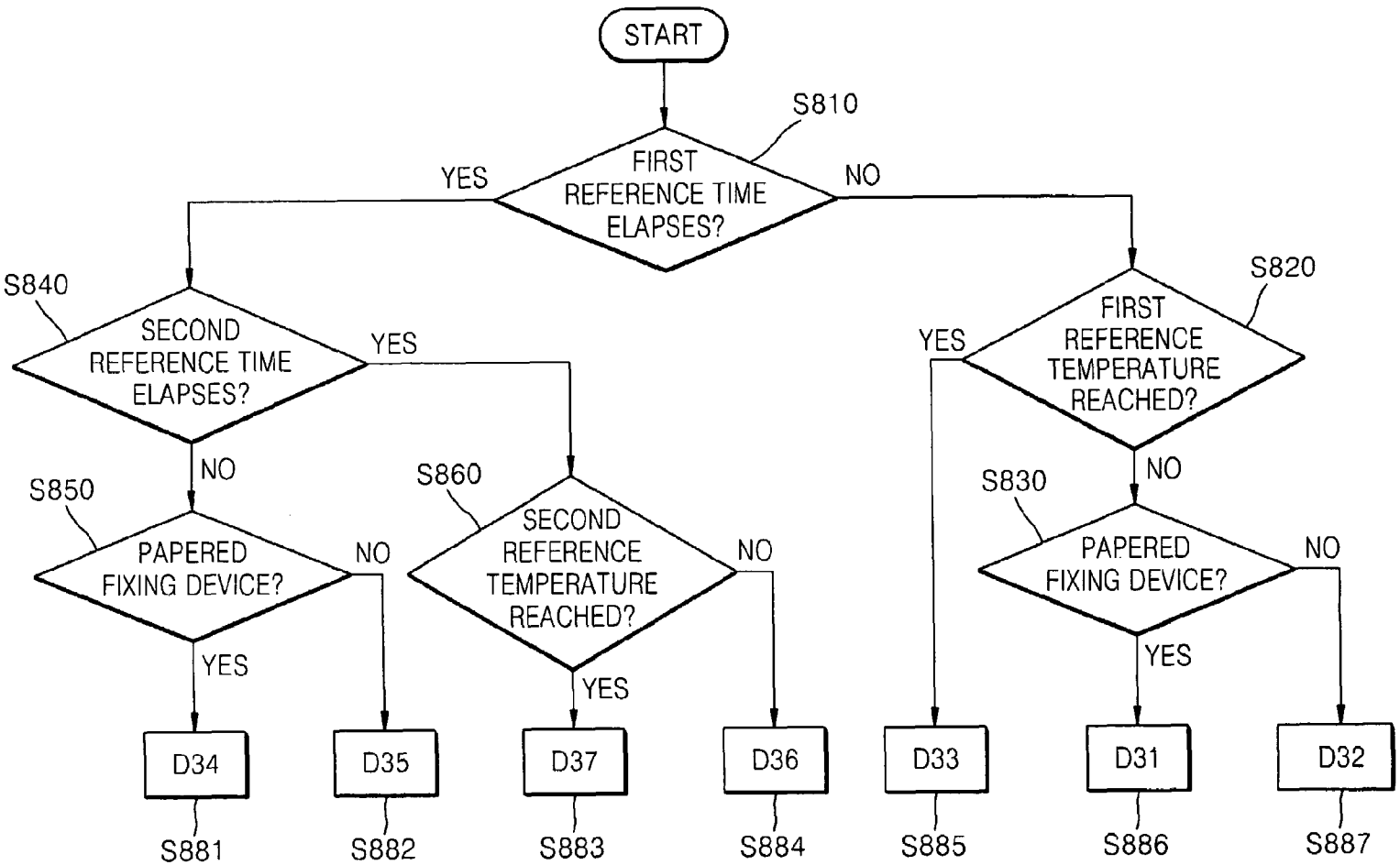
FIG. 8 is a flowchart of still another example of a temperature control method for the fixing device according to the embodiment of the present invention.

FIG. 8 is a flowchart of still another exemplary temperature control method for the fixing device according to an embodiment of the present invention.

Firstly, it is determined whether or not a first reference time elapses (S810). If the first reference time does not elapse, the temperature of the fixing device may rapidly change. If the first reference time has not elapsed, it is determined whether or not the fixing device reaches the first reference temperature (S820). If the fixing device does not reach the first reference temperature, it is determined whether or not the fixing device is a paper fixing device (S830). The paper fixing device is controlled by using a duty ratio D31 larger than a duty ratio for a non-paper fixing device D32 (S886 and S887). If the fixing device does reach the first reference temperature, the temperature of the fixing device is controlled by using a third duty ratio D33 smaller than the second duty ratio D32.

If the first reference time elapses, it is determined whether or not a second reference time elapses (S840). If the first reference time elapses and the second reference time does not elapse, it is determined whether or not the fixing device is a paper fixing device (S850). The paper fixing device is controlled by using a duty ratio D34 larger than that for the non-paper fixing device D35 (S881 and S882). If the second reference time elapses, it is determined whether or not the fixing device reaches a second reference temperature (S860). If the fixing device reaches the second reference temperature, the fixing device is controlled by using a duty ratio D37 smaller than a duty ratio D36 for a fixing device which does not reach the second reference temperature (S883 and S884).

As described above, a preferred relation among the duty ratios D31, D32, D33, D34, D35, D36, and D37 is represented by Equation 3.

$$D31>D32>D33>D34>D35>D36>D37 \quad \text{[Equation 3]}$$

The example shown in FIG. 8 is preferably adapted to the printing state of the fixing device according to exemplary embodiments of the present invention. In the example, the presence of the paper sheet in the fixing device is additionally detected, so that the fixing device can be maintained at an optimal temperature.

The temperature control method according to the embodiments of the invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

While the present invention has been particularly shown and described with reference to exemplary embodiments thereof, it will be understood by those skilled in the art that various changes in form and details may be made therein without departing from the spirit and scope of the present invention. For example, although the temperature of the fixing device is controlled by using two reference times and temperatures, the invention is not limited thereto; the temperature of the fixing device can be more accurately controlled by using three or more reference times and temperatures. Therefore, the embodiments of the present invention will be defined by the appended claims. Therefore, the embodiments of the present invention will be defined by the appended claims.

According to a temperature control method for the fixing device of the present invention, since a temperature of the fixing device built in an electrophotographic image forming apparatus is controlled by using different control variables corresponding to operating states, it is possible to minimize overshoot and rippling.

In addition, since the temperature of the fixing device is controlled by using at least two reference times and temperatures, it is possible to reduce power consumption and extend the lifespan of the fixing device and its parts.

What is claimed is:

1. A fixing device built in an electrophotographic image forming apparatus, comprising:

a power supplying unit for supplying power to the fixing device:

a control variable determination unit for determining control variables corresponding to at least one operating state of fixing device, wherein the control variables include a plurality of reference temperatures for each of the at least one operating states and used for comparison to the temperature of the fixing device and a plurality of corresponding reference times for each of the at least one operating states;

a temperature detection unit for detecting the temperature of the fixing device; and a temperature control unit for controlling the temperature of the fixing device by using the control variables as input for reaching a target temperature corresponding to the at least one operating state of the fixing device, wherein the temperature control unit comprises a duty ratio adjustment unit for adjusting a duty ratio of the supplied power based on the determined control variables.

2. The fixing device according to claim 1, wherein the at least one operating state comprises a plurality of operating states, and the plurality of operating states comprise at least one of a standby state, a warming-up state, a pre-printing state, a printing state, and a post-printing state.

3. The fixing device according to claim 1, wherein the control variable determination unit comprises a control variable updating unit for updating the control variables based on an output temperature of the fixing device.

4. The fixing device according to claim 3, wherein, if the temperature of the fixing device is lower than the target temperature, the duty ratio adjustment unit compares the temperature of the fixing device to at least one of the reference temperatures and increases the duty ratio in proportion to the difference between the reference temperature and the temperature of the fixing device.

5. The fixing device according to claim 4, wherein, if the temperature of the fixing device is higher than the target temperature, the duty ratio adjustment unit compares the temperature of the fixing device to at least one of the reference temperatures and decreases the duty ratio in proportion to the difference between the reference temperature and the temperature of the fixing device.

6. The fixing device according to claim 4, wherein the duty ratio adjustment unit adjusts the duty ratio to be greater when the fixing device operates on paper than when the fixing device operates on non-paper.

7. The fixing device according to claim 4, wherein the duty ratio adjustment unit adjusts a switching duty ratio of a switch element which switches the power supplied by the power supplying unit.

8. The fixing device according to claim 1, wherein the plurality of reference temperatures and the plurality of corresponding reference times are independently determined.

9. A temperature control method for a fixing device built in an electrophotographic image forming apparatus, comprising the steps of:

determining control variables corresponding to at least one operating state of the fixing device, wherein the control variables include a plurality of reference temperatures for each of the at least one operating states and used for comparison to the temperature of the fixing device and a plurality of corresponding reference times for each of the at least one operating states;

detecting the temperature of the fixing device; and controlling the temperature of the fixing device by adjusting a duty ratio of power supplied to the fixing device by using the control variables as input for reaching a target temperature corresponding to the at least one operating state of the fixing device.

10. The temperature control method according to claim 9, wherein the at least one operating state comprises a plurality of operating states, and the plurality of operating states comprise at least one of a standby state, a warming-up state, a pre-printing state, a printing state, and a post-printing state.

11. The temperature control method according to claim 9, wherein the step of determining of the control variables comprises the step of updating the control variables based on the controlled temperature of the fixing device.

12. The temperature control method according to claim 11, wherein the step of controlling the temperature comprises the steps of:

if the temperature of the fixing device is lower than the target temperature, increasing the temperature of the fixing device by increasing the duty ratio in proportion to the difference between the target temperature and the temperature of the fixing device; and if the temperature of the fixing device is lower than the target temperature, decreasing the temperature of the fixing device by decreasing the duty ratio in proportion to the difference between the target temperature and the temperature of the fixing device.

13. The temperature control method according to claim 12, wherein the duty ratio is determined so that the duty ratio for a fixing device operating on paper is larger than the duty ratio for a fixing device operating on non-paper.

14. A temperature control method for a fixing device built in an electrophotographic image forming apparatus, comprising the steps of:

determining control variables corresponding to an operating state of the fixing device, wherein the control variables are used to control a temperature of the fixing device, wherein the control variables comprise at least one of: target temperatures corresponding to the operating states; at least one of reference temperatures used for comparison to the temperature of the fixing device; at least one of reference times for detecting the temperature of the fixing device; and at least one of duty ratios varying corresponding to the reference temperatures and the reference times and wherein the operating state comprises at least one of a standby state, a warming-up state, a pre-printing state, a printing state, and a post-printing state;

updating the control variables based on the controlled temperature of the fixing device;

detecting the temperature of the fixing device; and controlling the temperature of the fixing device by adjusting a duty ratio of power supplied to the fixing device by using the control variables, wherein, if the temperature of the fixing device is lower than the target temperature, increasing the temperature of the fixing device by increasing the duty ratio in proportion to the difference between the target temperature and the temperature of the fixing device; and if the temperature of the fixing device is lower than the target temperature, decreasing the temperature of the fixing device by decreasing the duty ratio in proportion to the difference between the target temperature and the temperature of the fixing device;

wherein the step of increasing of the temperature comprises the step of:

determining whether a first reference time elapses;

if the first reference time does not elapse, heating the fixing device with a first or second duty ratio corresponding to a result of comparison of the temperature of the fixing device and a first reference temperature;

if the first reference time elapses, determining whether or not a second reference time elapses, wherein the second reference time is longer than the first reference time;

if the second reference time does not elapse, heating the fixing device with a third duty ratio, wherein the third duty ratio is smaller than the first and second ratios; and if the second reference time does elapse, heating the fixing device with a fourth or fifth duty ratios corresponding to a result of comparison of the temperature of the fixing device and a second reference temperature, wherein the fourth and fifth duty ratios are smaller than the third duty ratio, wherein the second reference temperature is higher than the first reference temperature.

15. A temperature control method for a fixing device built in an electrophotographic image forming apparatus, comprising the steps of:

determining control variables corresponding to an operating state of the fixing device, wherein the control variables are used to control a temperature of the fixing device, wherein the control variables comprise at least one of: target temperatures corresponding to the operating states; at least one of reference temperatures used for comparison to the temperature of the fixing device; at least one of reference times for detecting the temperature of the fixing device; and at least one of duty ratios varying corresponding to the reference temperatures and the reference times and wherein the operating state comprises at least one of a standby state, a warming-up state, a pre-printing state, a printing state, and a post-printing state;

updating the control variables based on the controlled temperature of the fixing device;

detecting the temperature of the fixing device; and controlling the temperature of the fixing device by adjusting a duty ratio of power supplied to the fixing device by using the control variables, wherein, if the temperature of the fixing device is lower than the target temperature, increasing the temperature of the fixing device by increasing the duty ratio in proportion to the difference between the target temperature and the temperature of the fixing device; and if the temperature of the fixing device is lower than the target temperature, decreasing the temperature of the fixing device by decreasing the duty ratio in proportion to the difference between the target temperature and the temperature of the fixing device;

wherein the step of decreasing the temperature comprises the steps of:

determining whether a first reference time elapses;

if the first reference time does not elapse, heating the fixing device with a first or second duty ratio corresponding to a result of comparison of the temperature of the fixing device and a first reference temperature;

if the first reference time does elapse, determining whether or not a second reference time elapses, wherein the second reference time longer than the first reference time;

if the second reference time does not elapse, heating the fixing device with a third duty ratio, wherein the third duty ratio is smaller than the first and second ratios; and if the second reference time does elapse, heating the fixing device with a fourth or fifth duty ratios corresponding to a result of comparison of the temperature of the fixing device and a second reference temperature, wherein the fourth and fifth duty ratios are larger than the third duty ratio, wherein the second reference temperature is lower than the first reference temperature.

16. A computer-readable recording medium having embodied thereon a computer program for the temperature control method for executing the method, comprising the steps of:

determining control variables corresponding to an at least one operating state of the fixing device, wherein the control variables include a plurality of reference temperatures for each of the at least one operating states and used for comparison to the temperature of the fixing device and a plurality of corresponding reference times for each of the at least one operating states;

detecting the temperature of the fixing device; and controlling the temperature of the fixing device by adjusting a duty ratio of power supplied to the fixing device by using the control variables as input for reaching a target temperature corresponding to the at least one operating state of the fixing device.

17. The computer-readable recording medium having embodied thereon a computer program for the temperature control method according to claim 16, wherein the step of determining of the control variables comprises updating the control variables based on a controlled temperature of the fixing device.

18. The computer-readable recording medium having embodied thereon a computer program for the temperature control method according to claim 16, wherein the step of controlling the temperature comprises the steps of:

if the temperature of the fixing device is lower than a target temperature, increasing the temperature of the fixing device by increasing the duty ratio in proportion to the difference between the target temperature and the temperature of the fixing device; and if the temperature of the fixing device is lower than the target temperature, decreasing the temperature of the fixing device by decreasing the duty ratio in proportion to the difference between the target temperature and the temperature of the fixing device.

* * * * *